US011383401B2

(12) United States Patent
Dutterer

(10) Patent No.: US 11,383,401 B2
(45) Date of Patent: Jul. 12, 2022

(54) TABLE SAW

(71) Applicant: TECHTRONIC CORDLESS GP, Anderson, SC (US)

(72) Inventor: David E. Dutterer, Belton, SC (US)

(73) Assignee: Techtronic Cordless GP, Anderson, SC (US)

( * ) Notice: Subject to any disclaimer, the term of this patent is extended or adjusted under 35 U.S.C. 154(b) by 0 days.

(21) Appl. No.: 16/898,663

(22) Filed: Jun. 11, 2020

(65) Prior Publication Data

US 2020/0391403 A1 Dec. 17, 2020

Related U.S. Application Data

(60) Provisional application No. 62/861,137, filed on Jun. 13, 2019.

(51) Int. Cl.

| | |
|---|---|
| ***B27G 19/08*** | (2006.01) |
| ***B27G 19/04*** | (2006.01) |
| ***B26D 7/22*** | (2006.01) |

(52) U.S. Cl.

CPC ..... *B27G 19/08* (2013.01); *B26D 7/22* (2013.01); *B27G 19/04* (2013.01)

(58) Field of Classification Search

CPC ..... B27G 19/08; B27G 19/04; B26D 7/22; B23D 47/025; B23D 45/06; B23D 45/061; B23D 45/062; B23D 45/063; B23D 45/065; B23D 45/066; B23D 45/067; B23D 45/068; Y10T 83/7734; B27B 5/181; B27B 5/182; B27B 5/184; B27B 5/185; B27B 5/187; B27B 5/188; B27B 5/202

See application file for complete search history.

(56) References Cited

U.S. PATENT DOCUMENTS

| | | | | | |
|---|---|---|---|---|---|
| 2,020,222 | A * | 11/1935 | Tautz | B23D 47/025 | 269/309 |
| 3,289,713 | A * | 12/1966 | Herzog | B23D 47/025 | 292/228 |
| 5,159,864 | A * | 11/1992 | Wedemeyer | B23D 47/025 | 83/13 |
| 5,398,740 | A * | 3/1995 | Miller | B23Q 1/0054 | 144/286.5 |
| 5,970,835 | A * | 10/1999 | Kenyon | B23D 47/025 | 144/1.1 |
| 7,134,373 | B1 * | 11/2006 | Vice | B23D 47/025 | 83/477.2 |
| 9,919,369 | B2 * | 3/2018 | Gass | B25H 1/14 | |
| 2001/0013268 | A1 * | 8/2001 | Dils | B23D 45/062 | 83/477.2 |
| 2004/0159200 | A1 * | 8/2004 | Stoffel | B23D 47/025 | 83/581 |

(Continued)

*Primary Examiner* — Jonathan G Riley

(74) *Attorney, Agent, or Firm* — Michael Best & Friedrich LLP

(57) ABSTRACT

A table saw including a table, an opening in the table through which a saw blade extends, and a throat plate receivable within the opening. The throat plate includes a top surface that is co-planar with a top surface of the table. The table saw further includes an anti-kickback pawl disposed above the throat plate and a wear plate coupled to the throat plate in facing relationship with the anti-kickback pawl, where at least a portion of the wear plate is sub-flush with the top surface of the throat plate.

18 Claims, 4 Drawing Sheets

(56) References Cited

U.S. PATENT DOCUMENTS

| | | | | |
|---|---|---|---|---|
| 2005/0160895 | A1* | 7/2005 | Garcia | B27G 19/08 83/581 |
| 2006/0219076 | A1* | 10/2006 | Gass | B23D 47/025 83/471.3 |
| 2007/0186739 | A1* | 8/2007 | Peot | B27G 19/08 83/477.2 |
| 2008/0156162 | A1* | 7/2008 | Chuang | B23D 47/025 83/478 |
| 2009/0261217 | A1* | 10/2009 | Clark | B23Q 1/25 248/188.4 |
| 2011/0203438 | A1* | 8/2011 | Nenadic | B23D 45/06 83/477.2 |
| 2015/0151371 | A1* | 6/2015 | Gass | B23D 47/025 83/859 |
| 2016/0263680 | A1* | 9/2016 | Doumani | B23D 59/002 |
| 2017/0072481 | A1* | 3/2017 | Gass | B27G 19/00 |
| 2018/0339422 | A1* | 11/2018 | Fulmer | B23D 47/02 |
| 2020/0391403 | A1* | 12/2020 | Dutterer | B27G 19/08 |

* cited by examiner

TABLE SAW

CROSS-REFERENCE TO RELATED APPLICATIONS

This application claims priority to prior-filed U.S. Provisional Patent Application No. 62/861,137, filed on Jun. 13, 2019, the entire contents of which are incorporated by reference herein.

FIELD OF THE DISCLOSURE

The present disclosure relates generally to power tools, and in particular to improvements for power table saws.

SUMMARY OF THE DISCLOSURE

In one aspect, the invention provides a table saw including a table, an opening in the table through which a saw blade extends, and a throat plate receivable within the opening. The throat plate includes a top surface that is co-planar with a top surface of the table. The table saw further includes an anti-kickback pawl disposed above the throat plate and a wear plate coupled to the throat plate in facing relationship with the anti-kickback pawl, where at least a portion of the wear plate is sub-flush with the top surface of the throat plate.

In another aspect, the invention provides a throat plate for a table saw. The throat plate includes a front end, an opposite back end, a top surface that is co-planar with a top surface of the table, and a wear plate disposed adjacent to the back end. The throat plate further includes a wear plate pocket in which the wear plate is received such that no portion of the wear plate extends above the top surface of the throat plate. The wear plate pocket defines a bottom surface, a first depth measured at the back end from the top surface to the bottom surface, and a second depth measured at an opposite end of the wear plate pocket from the top surface to the bottom surface. The second depth is greater than the first depth. The wear plate has constant thickness that is substantially equal to the first depth such that the wear plate sits flush with the top surface adjacent the back end. The wear plate sits sub-flush with the top surface at the opposite end of the wear plate pocket.

Other independent aspects of the invention will become apparent by consideration of the detailed description, claims and accompanying drawings.

Before any embodiments of the disclosure are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
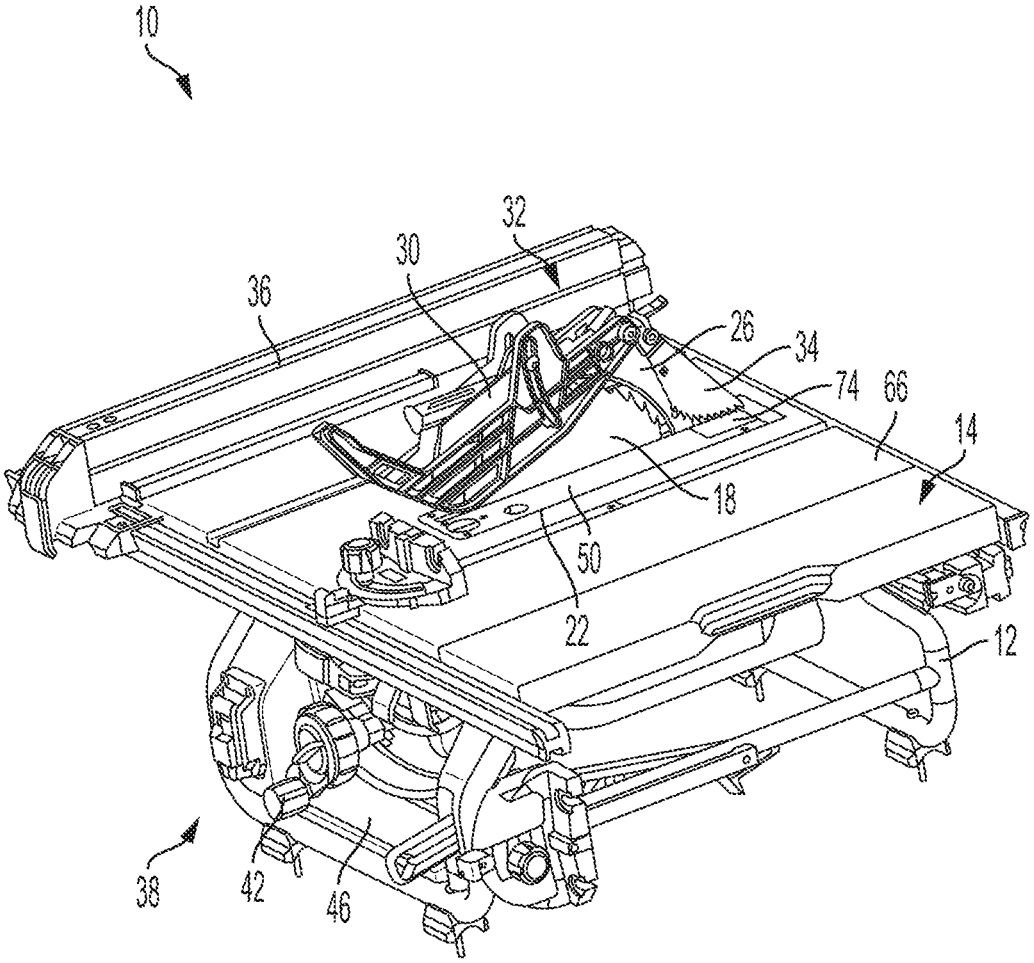
FIG. 1 is a front perspective view of a table saw in accordance with an embodiment of the present disclosure.

With reference to FIG. 1, a table saw 10 includes a tubular base 12, a table 14 atop the base 12 upon which a workpiece is supported, and a saw blade 18 protruding through an opening 22 in the table 14. The table saw 10 may include a riving knife 26 positioned behind the saw blade 18 and a blade guard assembly 30 supported by the riving knife 26 for covering the top and opposite sides of the saw blade 18. The riving knife 26 may also support an anti-kickback pawl assembly 32, which prevents "kickback" of the workpiece toward the operator of the table saw 10. Specifically, the assembly 32 includes two serrated pawls 34 (although only one of which is shown) that are biased toward the table 14 and slide along the workpiece during a cutting operation to inhibit the workpiece from inadvertently moving upward relative to the table 14. Also, a guide rail 36 is removably coupled to the table 14 for guiding a workpiece through the saw blade 18 during the cutting operation.

With continued reference to FIG. 1, the table saw 10 may additionally include a blade height adjustment mechanism 38 that is operable to raise and lower the saw blade 18 relative to the table 14. The blade height adjustment mechanism 38 may include a crank 42 that is disposed in front of a front panel 46 of the base 12. The crank 42 is rotatable, for example, in a clockwise direction to raise the saw blade 18. In contrast, the crank 42 is rotatable, for example, in a counter-clockwise direction to lower the saw blade 18. Other types of blade height adjustment mechanisms are contemplated.

Figure 2:
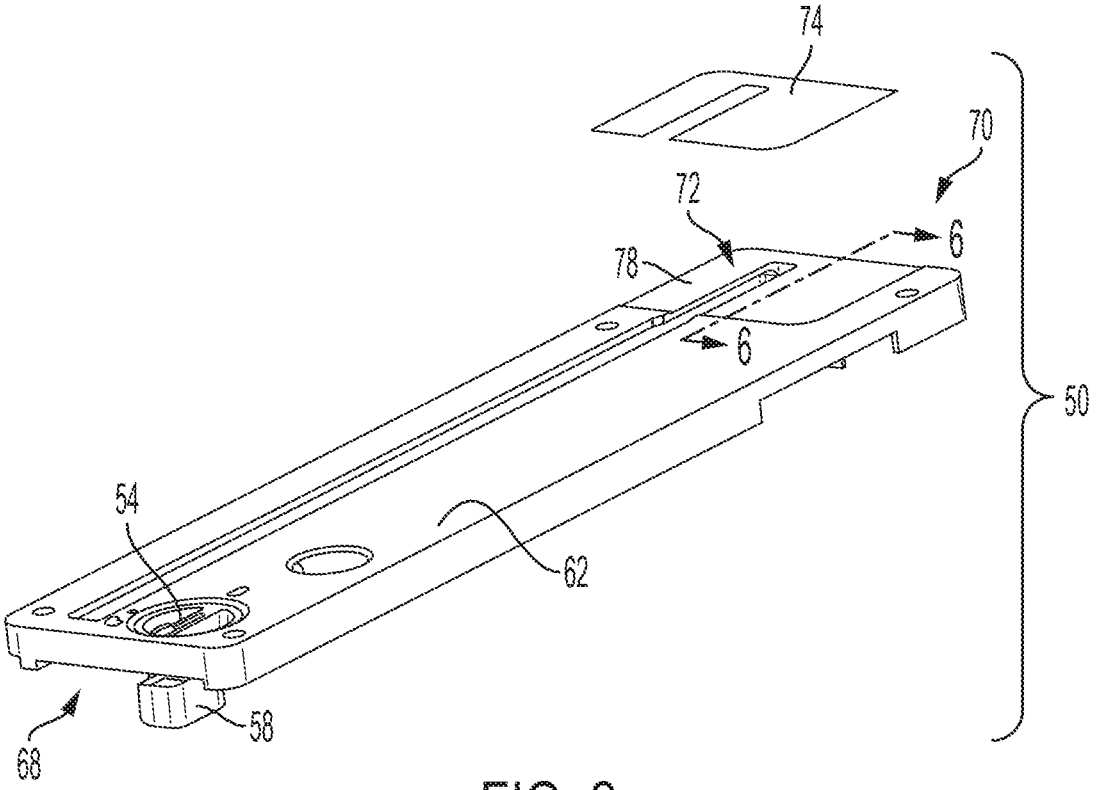
FIG. 2 is a front perspective view of a throat plate of the table saw of FIG. 1, illustrating a wear plate exploded from the throat plate.

The table saw 10 also includes a motor (not shown) for rotationally driving the saw blade 18 during the cutting operation. The motor, as well as other components disposed underneath the table 14, are accessible for maintenance through a side of the tubular base 12 or through the opening 22 in the table 14 after a throat plate 50 is removed from the table 14. Typically, the throat plate 50 is seated within the opening 22 during the cutting operation. As shown in FIG. 2, the throat plate 50 may be removable from the table 14 by rotating a knob 54, which correspondingly rotates a locking arm 58 that selectively interferes with an underneath portion of the table 14 (e.g., in a locking position of the locking arm 58). When the locking arm 58 no longer mechanically interferes with the underneath portion of the table 14 (e.g., in a released position of the locking arm 58), the throat plate 50 is capable of being removed from the table 14.

Figure 3:
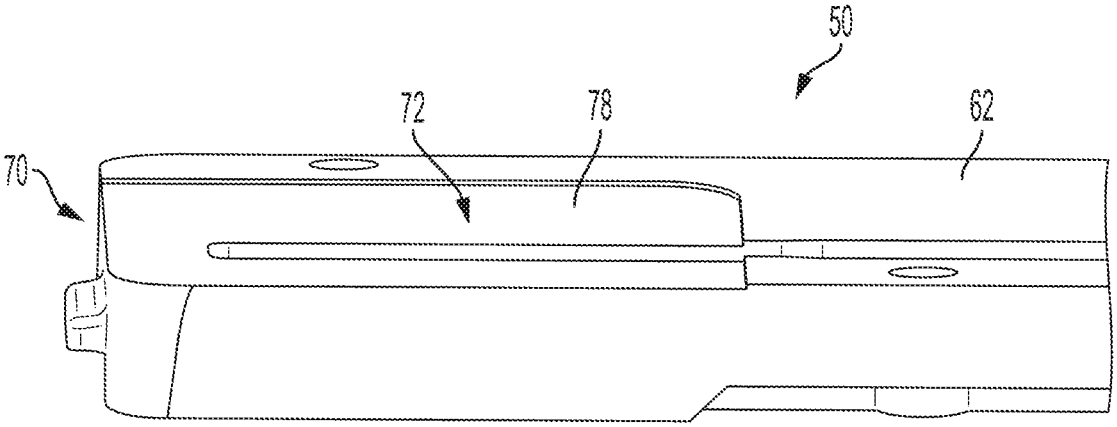
FIG. 3 is a side perspective view of the throat plate of FIG. 2, illustrating a wear plate pocket capable of accommodating the wear plate.

With reference to FIGS. 2 and 3, the throat plate 50 may additionally include a top surface 62 that is co-planar with a top surface 66 of the table 14 when the throat plate 50 is seated within the opening 22. The throat plate 50 also includes a front end 68, a back end 70, and a wear plate pocket 72 that is recessed from the top surface 62 of the throat plate 50 and disposed adjacent the back end 70 of the throat plate 50. A wear plate 74 is received within the wear plate pocket 72, such that no portion of the wear plate 74 extends above the top surface 62 of the throat plate 50. In some embodiments, portions of the wear plate 74 may be flush, or approximately flush, with the top surface 62 of the throat plate 50. The wear plate 74 may be composed of a metallic material and coupled to the throat plate 50 in a location generally beneath the vertically projected area of the anti-kickback pawl assembly 32. As a result of the pawls 34 being biased toward the table 14, the serrated pawls 34 rest upon the wear plate 74 when there is no workpiece being fed through the blade 18. The wear plate 74 inhibits the top surface 62 of the throat plate 50 from being marred by the serrated pawls 34.

Figure 4:
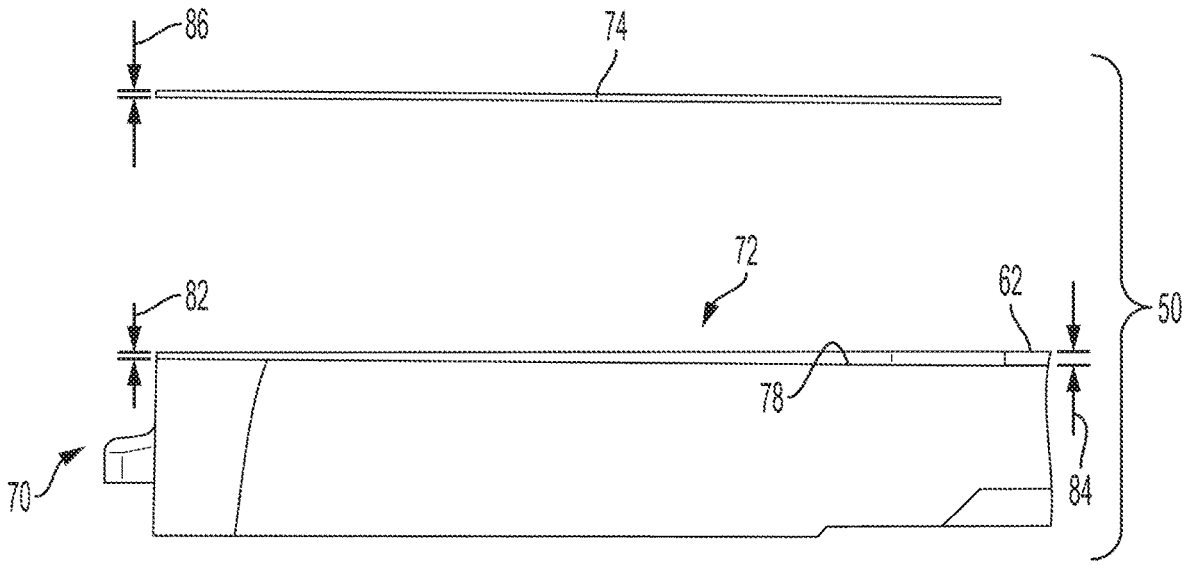
FIG. 4 is a side plan view of the throat plate of FIG. 2, illustrating the wear plate exploded from the wear plate pocket.
Figure 5B:
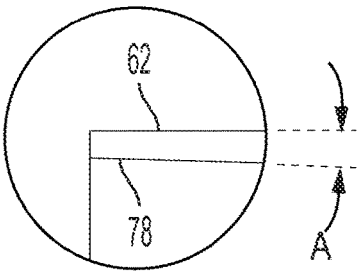
FIG. 5B is an enlarged view of the throat plate of FIG. 5A.
Figure 5A:
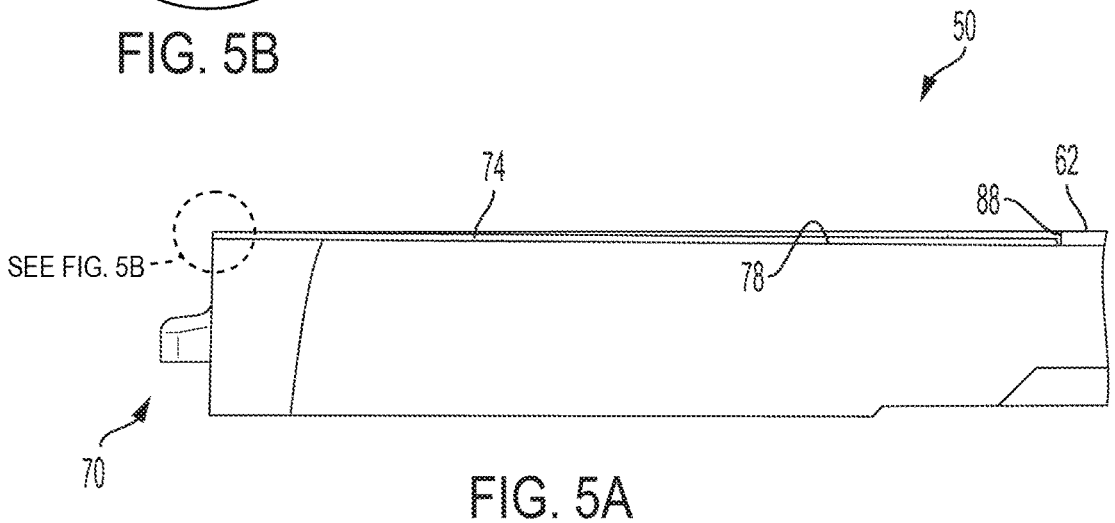
FIG. 5A is a side plan view of the throat plate of FIG. 2, illustrating the wear plate seated within the wear plate pocket.
Figure 6:
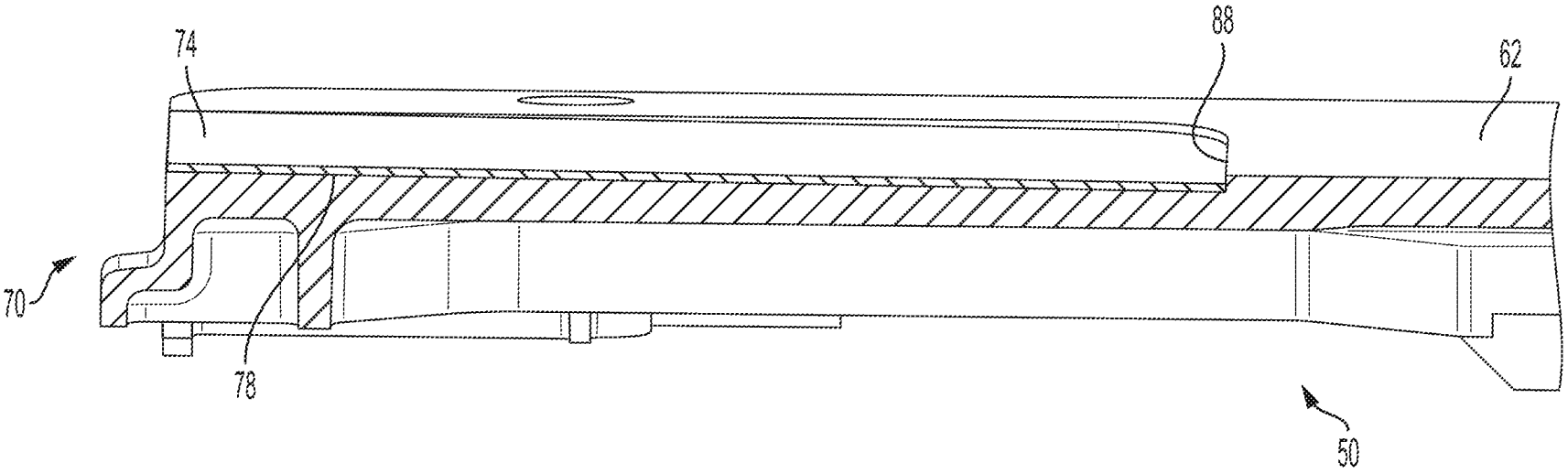
FIG. 6 is a cross-sectional view of the throat plate along line 6-6 of FIG. 2, illustrating the wear plate seated within the wear plate pocket.

With reference to FIGS. 4-5B, the wear plate pocket 72 includes a bottom surface 78 that is not parallel to the top surface 62 of the throat plate 50. Instead, the bottom surface 78 is acutely angled (or inclined) relative to the top surface 62 of the throat plate 50 by an angle A (FIG. 5B). Specifically, the bottom surface 78 is angled equal to or less than 1.0 degrees relative to the top surface 62 of the throat plate 50. More specifically, the bottom surface 78 is angled between approximately 0.2 degrees and approximately 1.0 degrees relative to the top surface 62 of the throat plate 50. Even more specifically, the bottom surface 78 is angled by an angle A of 0.3 degrees (±0.7 degrees) relative to the top surface 62 of the throat plate 50, with the bottom surface 78 sloping downward in a direction from the back end 70 toward the front end 68 (FIG. 5A). Stated another way, the wear plate pocket 72 has a first depth 82 adjacent the back end 70 of the throat plate 50 and a second depth 84 on an opposite end of the pocket 72, where the second depth 84 is greater than the first depth 82. The first and second depths 82, 84 are measured from the top surface 62 of the throat plate 50 to the bottom surface 78 of the wear plate pocket 72. The difference between the first depth 82 and the second depth 84 is approximately 0.01 inch to 0.02 inch. More specifically, the difference between the first depth 82 and the second depth 84 is approximately 0.012 inch, creating a slope (or incline) of 0.012 inch over a length of the wear plate pocket 72, which is approximately 2.25 inches to 2.3 inches.

The wear plate 74, in contrast, defines a constant thickness 86 that is approximately equal to the first depth 82. Therefore, the wear plate 74 may be approximately flush with the top surface 62 of the throat plate 50 adjacent the back end 70, whereas the opposite end of the wear plate 74 may be sub-flush with the top surface 62 of the throat plate 50 (FIG. 5A). The pocket 72, therefore, defines a vertical lip 88 adjacent the top surface 62 due to the wear plate 74 being sub-flush (or sunken) from the top surface 62 of the throat plate 50 to avoid wood chips from lodging underneath and lifting the wear plate 74.

Various features of the invention are set forth in the following claims.

What is claimed is:

1. A table saw comprising:

a table;

an opening in the table through which a saw blade extends;

a throat plate receivable within the opening, the throat plate including a top surface that is co-planar with a top surface of the table;

an anti-kickback pawl disposed above the throat plate; and a wear plate coupled to the throat plate in facing relationship with the anti-kickback pawl, wherein at least a portion of a top surface of the wear plate is sub-flush with the top surface of the throat plate, wherein the wear plate is disposed within a wear plate pocket in the throat plate, such that no portion of the wear plate extends above the top surface of the throat plate, wherein the wear plate pocket has a first depth adjacent a back end of the throat plate and a second depth at an opposite end of the wear plate pocket, wherein the first depth and the second depth are measured from the top surface of the throat plate to a bottom surface of the wear plate pocket, wherein the second depth is greater than the first depth.

2. The table saw of claim 1, further comprising a riving knife positioned behind the saw blade and extending upward from underneath the table to support the anti-kickback pawl above the wear plate.

3. The table saw of claim 1, wherein the wear plate comprises metal.

4. The table saw of claim 1, wherein the anti-kickback pawl is biased into contact with the wear plate.

5. The table saw of claim 1, wherein the throat plate further includes a front end and an opposite back end, wherein the wear plate is disposed proximate the back end.

6. The table saw of claim 5, wherein the throat plate further includes a knob that is disposed proximate the front end to which a locking arm is coupled for co-rotation therewith, and wherein the knob is rotatable by a user to move the locking arm between a locking position in which the throat plate is secured to the table, and a release position in which the throat plate is removable from the table.

7. The table saw of claim 6, wherein the knob is accessible from the top surface of the throat plate and the locking arm is positioned beneath the throat plate.

8. The table saw of claim 1, wherein the wear plate pocket sits on the bottom surface and the wear plate pocket defines a lip that surrounds at least a portion of the periphery of the wear plate.

9. The table saw of claim 8, wherein the bottom surface of the wear plate pocket is obliquely angled relative to the top surface of the throat plate.

10. The table saw of claim 8, wherein the bottom surface is angled between approximately 0.2 degrees and approximately 1.0 degrees relative to the top surface of the throat plate.

11. The table saw of claim 8, wherein the bottom surface is angled approximately 0.3 degrees relative to the top surface of the throat plate.

12. The table saw of claim 8, wherein the bottom surface of the wear plate pocket slopes downward in a direction from a back end of the throat plate toward an opposite front end of the throat plate.

13. The table saw of claim 1, wherein the difference between the first depth and the second depth is approximately 0.01 inch to 0.02 inch.

14. The table saw of claim 1, wherein the difference between the first depth and the second depth is approximately 0.012 inch.

15. The table saw of claim 1, wherein the wear plate has a constant thickness that is approximately equal to the first depth, such that one end of the wear plate is flush with the top surface of the throat plate adjacent the back end, and wherein an opposite end of the wear plate is sub-flush with the top surface of the throat plate.

16. The table saw of claim 15, wherein the wear plate pocket defines a lip where the top surface of the wear plate is sub-flush from the top surface of the throat plate.

17. A throat plate for a table saw, the throat plate comprising:

a front end;

an opposite back end;

a top surface that is co-planar with a top surface of the table;

a wear plate disposed adjacent to the back end;

a wear plate pocket in which the wear plate is received such that no portion of the wear plate extends above the top surface of the throat plate, wherein the wear plate pocket defines a bottom surface, a first depth measured at the back end from the top surface to the bottom surface, and a second depth measured at an opposite end of the wear plate pocket from the top surface to the bottom surface, wherein the second depth is greater than the first depth, wherein the wear plate has constant thickness that is substantially equal to the first depth such that the wear plate sits flush with the top surface adjacent the back end, and wherein the wear plate sits sub-flush with the top surface at the opposite end of the wear plate pocket.

18. The throat plate of claim 17, wherein the bottom surface slopes downward in a direction from the back end toward the front end at an angle of approximately 0.3 degrees relative to the top surface of the throat plate, defining a lip where the wear plate is sub-flush from the top surface of the throat plate.

* * * * *